United States Patent [19]

Salem et al.

[11] Patent Number: 4,459,747

[45] Date of Patent: Jul. 17, 1984

[54] MANUAL ADJUSTABLE DUAL CUTTING DEVICE

[76] Inventors: Fred J. Salem; Geraldine Salem, both of 907 Brandywine Cir., Atlanta, Ga. 30338

[21] Appl. No.: 437,580

[22] Filed: Oct. 28, 1982

[51] Int. Cl.[3] ..... B26B 25/00

[52] U.S. Cl. ..... 30/307; 30/292

[58] Field of Search ..... 30/300, 306, 307, 310, 30/292

[56] References Cited

U.S. PATENT DOCUMENTS

| | | | |
|---|---|---|---|
| 143,681 | 10/1873 | Emery | 30/307 |
| 278,103 | 5/1883 | Curtis . | |
| 690,489 | 1/1902 | Vander Wee | 30/307 X |
| 714,729 | 12/1902 | Millhiser | 30/307 |
| 1,073,592 | 9/1913 | Contenti . | |
| 1,306,783 | 6/1919 | Smolinsky . | |
| 1,362,174 | 12/1920 | Mosovsky | 30/307 |
| 1,534,576 | 11/1922 | Edgren . | |
| 2,089,881 | 8/1937 | Dohring | 30/307 |
| 2,568,353 | 12/1947 | Miseta | 30/122 |
| 3,590,483 | 6/1968 | Szczepanski | 30/295 X |
| 4,050,336 | 9/1977 | Stubbings | 30/300 |
| 4,281,458 | 8/1981 | Okada | 30/162 |
| 4,301,594 | 11/1981 | Okada | 30/292 X |

*Primary Examiner*—Jimmy C. Peters

*Attorney, Agent, or Firm*—Jones & Askew

[57] ABSTRACT

A cutting device comprising an elongate arm and a pair of mountings for circular rotatable cutting blades, each of the mountings being slidably mounted on the arm. A circular rotatable cutting blade is rotatably mounted on each of the mountings. Each of the mountings is selectively lockable in position on the arm so as to selectively prevent sliding movement of the mountings. An elongate handle is attached to the arm intermediate the pair of mountings.

4 Claims, 5 Drawing Figures

MANUAL ADJUSTABLE DUAL CUTTING DEVICE

TECHNICAL FIELD

The present invention relates to a manual cutting device, particularly such devices having dual or multiple adjustable cutting blades.

BACKGROUND OF THE INVENTION

Cutting devices are useful in many applications, but are particularly useful in sewing wherein pieces of fabric or cloth must be cut to a desired size and shape prior to assembly into a finished article. A specific example of such sewing activity is quilting and bias tape making. Quilting is the process of making a relatively large piece of material by joining together a number of relatively small pieces of material. Typically, the small pieces of material are cut from remnants or scraps of material using scissors or other cutting devices.

One such cutting device is disclosed in U.S. Pat. No. 4,281,458 (incorporated herein by reference) to Okada. That cutting device comprises an elongated knife blade which is retractable into a holder for safety when not in use. In order to cut pieces of cloth for quilting using a knife of the type disclosed in Okada, a first cut is made using a straight edge to guide the blade. A second cut is then made, again with the aid of a straight edge, by carefully measuring the distance from the first cut to the straight edge so that the two are parallel. The straight edge is then held in place while a second cut of the material is made by pulling the knife blade along the straight edge. In addition to requiring several steps, the foregoing method is disadvantageous because movement of the straight edge will result in non-parallel edges for the strip of material which is cut.

Cutting devices using a single rotatable cutting blade are also known. However, such rotating blade devices have the same disadvantages as straight knife blades in that they must usually be used in conjunction with a straight edge and are subject to measurement errors when making parallel cuts.

Both straight knife blade cutting devices and rotatable blade cutting devices frequently are inconvenient to use because they must be held at an awkward angle for the blade to be properly positioned for cutting.

SUMMARY OF THE INVENTION

The present invention relates to a cutting device comprising an elongate arm and a pair of mountings for circular rotatable cutting blades, each of the mountings being slidably mounted on the arm. A circular rotatable cutting blade is rotatably mounted on each of the mountings. Each of the mountings is selectively lockable in position on the arm so as to selectively prevent sliding movement of the mountings. An elongate handle is attached to the arm intermediate the pair of mountings.

Accordingly, it is an object of the present invention to provide an improved cutting device.

It is another object of the present invention to provide a cutting device which can make dual parallel cuts.

Another object of the present invention is to provide a cutting device which makes multiple cuts of adjustable width.

Still another object of the present invention is to provide a cutting device which protects the cutting blade from accidental damage and the user from accidential injury.

A further object of the present invention is to provide a manual cutting device which can be held during use at a comfortable angle.

These and other objects, features and advantages of the present invention will become apparent after a review of the following detailed description of the disclosed embodiment and the appended drawing and claims.

DETAILED DESCRIPTION OF THE DISCLOSED EMBODIMENT

Figures 1, 4:
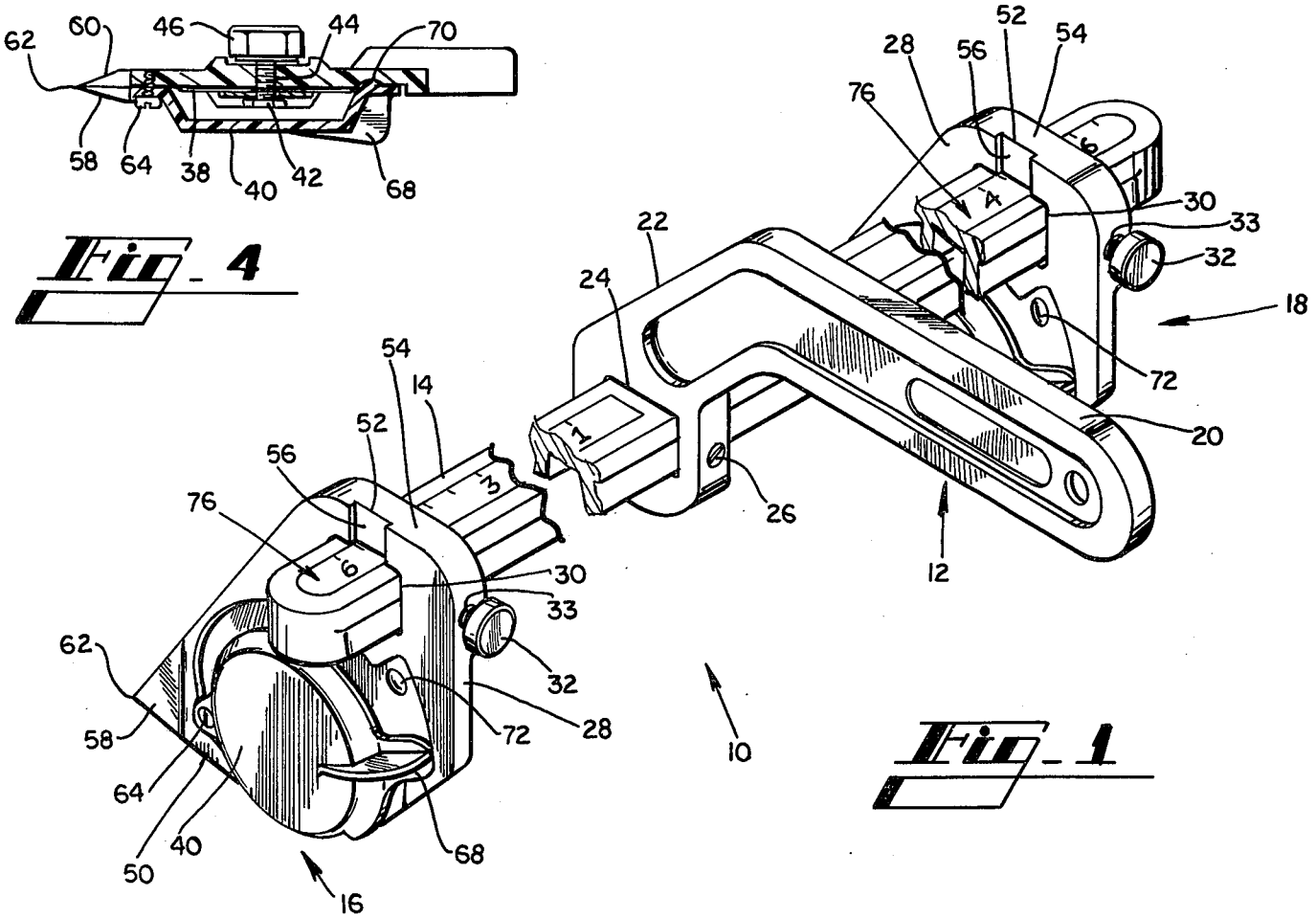
FIG. 1 is a pictorial view of a disclosed embodiment of the cutting device of the present invention.
FIG. 4 is a top cross-sectional view of one of the cutting assemblies of the cutting device shown in FIG. 1.

Referring now to the drawing, in which like numbers indicate like elements throughout the several views, it will be seen that there is a cutting device 10 in accordance with the present invention. The cutting device 10 comprises a handle 12, a cross bar or elongate track member 14 and a pair of cutting assemblies 16, 18.

The handle 12 comprises two leg portions 20, 22 which form an obtuse angle, such as at A, therebetween. The first leg portion 20 of the handle 12 forms the grip portion of the handle, i.e. the portion of the handle which is manually grasped by a hand. The second leg portion 22 of the handle 12 forms the track member attachment portion of the handle, i.e. the portion of the handle to which the track member 14 is attached.

The track member 14 is rod or channel-shaped; however, the particular cross-sectional shape of the track member is not significant. An opening 24 is defined by the handle adjacent the lower end of the second leg portion 22. The opening 24 is sized and shaped to receive the track member 14 therein. The track member 14 is positioned in the opening so that the handle 12 is intermediate the opposite ends of the track member. A screw 26 is provided in the handle 12 to secure the track member 14 in position. It will therefore be appreciated by those skilled in the art that the track member 14 is attached to the track member end of the handle 12 and is oriented orthogonally and transversely to the imaginary plane formed by the legs 20, 22 of the handle.

The two cutting assemblies 16, 18 are constructed identically. Each cutting assembly 16, 18 includes a generally flate body member 28. The body member 28 defines an opening 30 adjacent its upper end sized and shaped to slidably receive the track member 14. A set screw 32 extends through a hole 33 in the rear of the body member 28 in a horizontal plane in alignment with the opening 30 therein. The hole 33 and the set screw 32 are provided with mating threads so that rotation of the set screw moves with the set screw toward or away from the track member 14 for selective engagement of the set screw with the track member. Thus, it will be appreciated by those skilled in the art that when the set screw 32 is unscrewed so that it is not engaged with the track member 14, the cutting assemblies 16, 18 are free to slide laterally along the length of the track member and when the set screw is screwed into engagement with the track member, the cutting assemblies are prevented from sliding on the track member. The set screw 32 therefore provides a locking mechanism for the cutting assemblies 16, 18 so as to selectively prevent sliding movement on the track member 14.

The body member 28 has a left face 34 which lies in a substantially vertical plane. Formed in the face 34 is a generally circular recess 36 in which are partially housed a circular rotatable cutting blade 38 and a cover plate 40. Extending through the body member 28 in a direction substantially parallel to the track member 14 is a bolt 42 having a shaft 44 on which is rotatably mounted the cutting blade 38. A nut 46 is provided on the bolt 42 so that the bolt can be easily removed from the body member 28 to replace the cutting blade 38. The cutting blade 38 is of a particular size or diameter and the bolt 42 is positioned in the body member 28 so that the cutting edge 48 of the cutting blade extends beyond the bottom edge 50 of the body member (see FIG. 5).

A notch 52 is formed in the upper portion of the left face 34 of the body member 28. The notch 52 extends from the opening 30 to the top 54 of the body member 28. The notch 52 includes a face 56 which lies in a substantially vertical plane. The notch 52 is sized and shaped so that the face 56 lies in substantially the same plane as that formed by the circular cutting edge 48 of the cutting blade 38. The front edge of the body member 28 includes beveled faces 58, 60 which form a point 62. The point 62 also lies in substantially the same plane as that formed by the face 56 and the cutting edge 48 of the respective cutting assembly.

Figure 5:
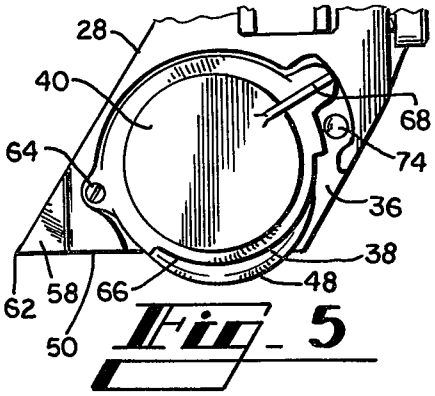
FIG. 5 is a partial side view of one of the cutting assemblies of the cutting device shown in FIG. 1 shown with the blade cover plate in an up position.
Figure 2:
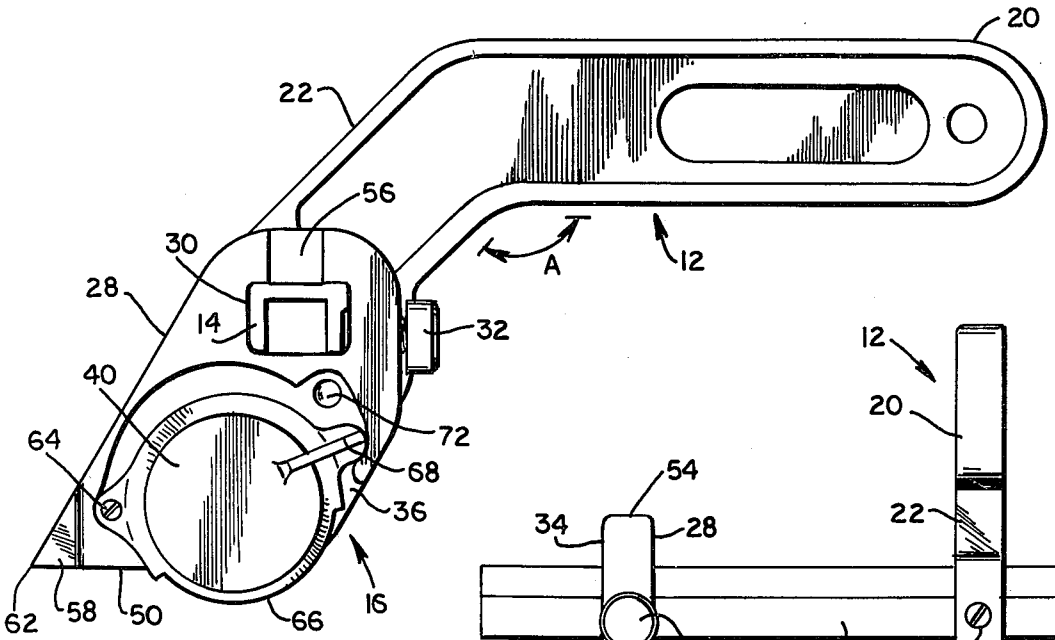
FIG. 2 is a side view of the cutting device shown in FIG. 1.
Figure 3:
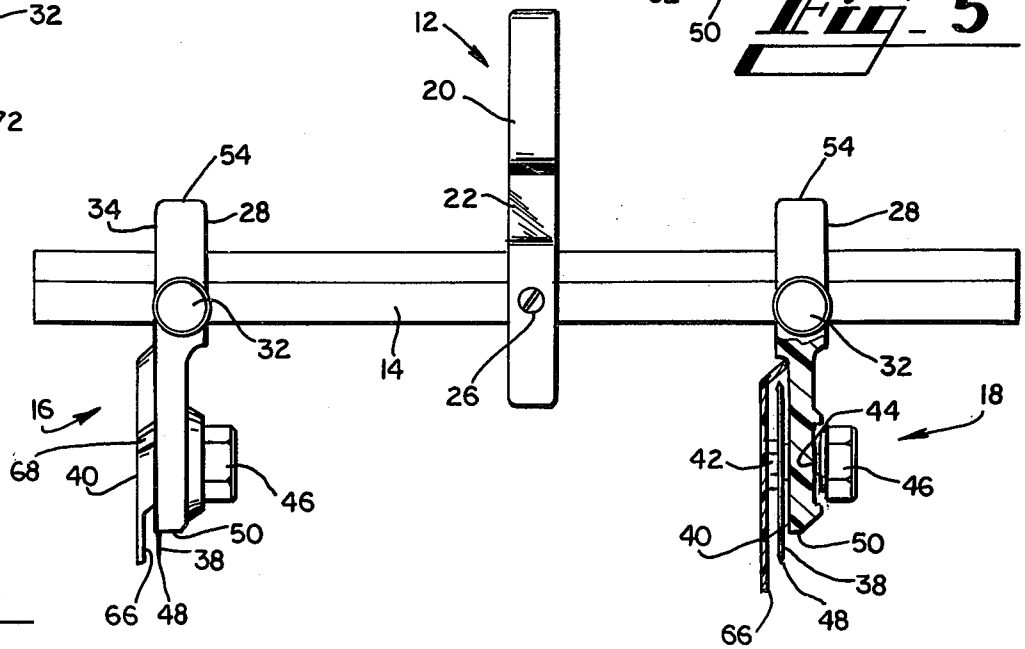
FIG. 3 is a rear view of the cutting device shown in FIG. 1 shown with the right cutting assembly partially broken away.

The cover plate 40 is pivotally attached to the body member 28 by a screw 64 which is eccentric to the cover plate. The cover plate 40 can therefore move in an arc about the screw 64 from a down position, as shown in FIGS. 1, 2 and 3, to an up position, as shown in FIG. 5. The cover plate 40 is of a specific size or diameter and the screw 64 is positioned so that when the cover plate is in the down position, the bottom edge 66 of the cover plate extends beyond the cutting edge 48 of the cutting blade 38 (see FIGS. 2 and 3). Conversely, when the cover plate 40 is in the up position (FIG. 5), the cutting edge 48 of the cutting blade 38 extends beyond the bottom edge 66 of the cover plate.

The cover plate 40 includes a flange 68 extending outwardly therefrom to facilitate manual movement of the cover plate with, for example, a thumb. The cover plate 40 also includes a boss 70 (FIG. 4) on the side adjacent the body member 28 which mates with one of an upper indentation 72 (FIG. 5) or a lower indentation 74 (FIG. 2) formed in the body member 28. The boss 70 and indentations 72, 74 provide a temporary lock for maintaining the cover plate 40 in its up position or its down position.

A measuring scale 76 is printed on the top surface of the track member 14 so that the face 56 of the notch 52 will be in register therewith. The scale 76 is preferably printed so that zero distance is positioned at the handle 12 with increasing measurements towards the opposite ends of the track member 14. The scale 76 is also preferably printed so that when the face 56 of two cutting assemblies 16, 18 is aligned with a desired indicia on the scale, that indicia corresponds to the distance between the cutting blade 38 of the left hand cutting assembly 16 and the cutting blade of the right hand cutting assembly 18.

Use of the cutting device 10 will now be considered. A piece of fabric (not shown) is placed on a flat, smooth, substantially horizontal surface. A width to which it is desired to cut the fabric is selected, for example four inches. The set screw 32 of the left cutting assembly 16 is loosened and the left cutting assembly is slid along the length of the track member 14 until the indicia "4" (not shown) is aligned with the face 56 of the left cutting assembly. The set screw 32 of the left cutting assembly 16 is then tightened into contact with the track member so that the left cutting assembly is locked in position. The set screw 32 of the right cutting assembly 18 is then loosened, slid along the track until its face 56 aligns with the indicia "4" of the scale 76 and the set screw is retightened to lock the right cutting assembly in place. It should be noted that the scale 76 can be printed at one-half the actual distance to provide a direct reading of the distance between the two cutting blades. For example, the indicia for four inches is printed two inches on either side of the handle 12 thereby making the distance between the two cutting blades four inches.

With the cutting assemblies 16, 18 locked in position on the track member 14, the cover plates are moved from their down position to their up position so as to expose the cutting edges 48 of the two cutting blades 38 (FIG. 5). This is done by placing a thumb on the under side of the flange 68 and exerting upward pressure so that the cover plate moves in an arc about the screw 64 and the boss 70 moves from the lower indentation 74 to the upper indentation 72.

The grip portion 20 of the handle 12 is then grasped in the palm of the hand with the fingers wrapping under the handle and the thumb resting on top of the grip portion of the handle. The points 62 of the two cutting assemblies are aligned on a portion of the fabric along which it is desired that the parallel cuts be made. This can be especially important when the fabric has a pattern.

The cutting edges 48 of the cutting blades 38 of the two cutting assemblies 16, 18 are placed in contact with the fabric. With the grip portion 20 of the handle 12 in a substantially horizontal plane, the cutting device 10 is pulled or pushed in a horizontal direction, i.e. in a direction parallel to the plane formed by the handle 12, while exerting downward pressure on the handle. As the cutting device 10 is pulled across the fabric, the cutting blades 38 rotate and the cutting edges 48 cut the fabric as it passes thereunder.

After the cutting operation is completed, the cover plates 40 of the two cutting assemblies 16, 18 are moved into the down position to protect the cutting blades 38 from damage and to prevent accidental injury from the sharp cutting edges 48 to the user. This can be done by placing the thumb on the upper surface of the flange 68 and exerting downward pressure to move the cover plate 40 in an arc about the screw 64 and move the boss 70 from the upper indentation 72 to the lower indentation 74. The cutting device 10 can also be disassembled for convenience of packaging and safety in storing.

It is also specifically contemplated that the cutting device of the present invention can be used with only one cutting assembly. This can be done by loosening the set screw 30 of one of the cutting assemblies and sliding the cutting assembly off one of the ends of the track assembly. The remaining cutting assembly is then preferably slide on the track member as close to the handle as possible and locked in position.

It should be understood, of course, that the foregoing relates only to a preferred embodiment of the present invention and that numerous modifications or alterations may be made therein without departing from the spirit and scope of the invention as set forth in the appended claims.

I claim:

1. A manual cutting device comprising:

an elongate track member;

at least two cutting blade housing members slidably attached to said track member;

a circular rotatable cutting blade rotatably mounted on each of said housing members at a position spaced from said track member and substantially perpendicular thereto;

means for selectively preventing sliding movement of each of said housing members;

an elongate handle member attached to said track member, said handle member being substantially parallel to said cutting blade; and said cutting blade being mounted on said housing member such that only a portion of said cutting blade extends beyond said housing member.

2. The cutting device of claim 1 further comprising a cover member mounted on each of said housing members, said cover member having a first position wherein a portion of said cover member extends beyond said housing member and said cutting blade and a second position wherein a portion of said cutting blade extends beyond said cover member.

3. The cutting device of claim 1 wherein said handle member comprises a first leg connected to a second leg at an obtuse angle therebetween, said second leg being connected to said track member such that when said first leg is substantially horizontal, said cutting blades are operative to cut material in a substantially horizontal plane.

4. The cutting device of claim 1 further comprising a measurement scale on said track member operatively associated with said housing members to provide an indication of the spacing between said cutting blades.

* * * * *